US008523247B2

(12) United States Patent
Talpe

(10) Patent No.: US 8,523,247 B2
(45) Date of Patent: Sep. 3, 2013

(54) CYLINDER LOCK WITH PIVOTALLY-MOUNTED BOLT

(76) Inventor: Joseph Talpe, Heestert-Zwevegem (BE)

( * ) Notice: Subject to any disclaimer, the term of this patent is extended or adjusted under 35 U.S.C. 154(b) by 769 days.

(21) Appl. No.: 12/618,278

(22) Filed: Nov. 13, 2009

(65) Prior Publication Data

US 2010/0123320 A1 May 20, 2010

(30) Foreign Application Priority Data

Nov. 14, 2008 (EP) ..... 08169214

(51) Int. Cl.
*E05C 9/12* (2006.01)
*E05C 5/00* (2006.01)

(52) U.S. Cl.
USPC ..... 292/39; 292/5; 292/51; 292/280; 70/107; 70/139

(58) Field of Classification Search
USPC ..... 70/91, 92, 101, 103–108, 110, 111, 70/121, 123, 124, 127, 129, 135, 137, 139, 70/141, 144, 145, 150, 152, 199, 467–471, 70/478–483, 489, DIG. 42; 292/3–5, 7, 11, 292/24–26, 44, 45, 47, 48, 34, 35, 39, 46, 292/51, 53, 63–65, 95–98, 111, 112, 194, 292/195, 199, 221, 222, 224, 227, 232, 234, 292/237, 240, 280, 92
See application file for complete search history.

(56) References Cited

U.S. PATENT DOCUMENTS

| | | | | | |
|---|---|---|---|---|---|
| 1,504,176 | A | * | 8/1924 | Wright | 70/116 |
| 3,175,376 | A | * | 3/1965 | Cantwell | 70/131 |
| 3,695,068 | A | * | 10/1972 | Eads et al. | 70/107 |
| 3,899,906 | A | * | 8/1975 | Bradstock | 70/139 |
| 4,127,016 | A | * | 11/1978 | Ibsen | 70/92 |
| 4,151,070 | A | * | 4/1979 | Allan et al. | 208/59 |
| 4,218,903 | A | * | 8/1980 | Eads | 70/107 |
| 4,231,597 | A | * | 11/1980 | Pelcin | 292/164 |
| 4,663,950 | A | * | 5/1987 | Mascotte | 70/135 |
| 4,962,653 | A | * | 10/1990 | Kaup | 70/107 |
| 5,452,927 | A | * | 9/1995 | Uyeda | 292/202 |
| 5,495,731 | A | * | 3/1996 | Riznik | 70/108 |
| 5,622,065 | A | * | 4/1997 | Persiano | 70/139 |
| 5,951,068 | A | * | 9/1999 | Strong et al. | 292/39 |

(Continued)

FOREIGN PATENT DOCUMENTS

| | | | |
|---|---|---|---|
| EP | 141891 | A1 * | 5/1985 |
| EP | 325215 | A2 * | 7/1989 |

(Continued)

*Primary Examiner* — Carlos Lugo
*Assistant Examiner* — Alyson M Merlino
(74) *Attorney, Agent, or Firm* — Sughrue Mion, PLLC

(57) ABSTRACT

A cylinder lock 1, including a housing 6 with an opening 7 for receiving a lock cylinder 12 with a radially protruding cam 17; a bolt 2 pivotally moveable between a retracted position and an extended position; a ring 15 including a radial opening 16 for engaging the lock cylinder cam 17; and a slider 20, coupled between the pivotally-mounted bolt 2 and the ring 15. The ring 15 also includes a toothed arc 18 for cooperating with a toothed rack 22 of the slider, and the slider including a recess 23 for engaging the lock cylinder cam 17. The ring 15 also has a raised flank 19 for cooperating with at least one stop of the slider.

10 Claims, 8 Drawing Sheets

(56) References Cited

U.S. PATENT DOCUMENTS

| | | | | |
|---|---|---|---|---|
| 6,138,485 | A * | 10/2000 | Fuss et al. | 70/107 |
| 6,324,876 | B1 * | 12/2001 | Prevot et al. | 70/107 |
| 7,228,719 | B2 * | 6/2007 | Alchin et al. | 70/84 |
| 2007/0113603 | A1 * | 5/2007 | Polster | 70/107 |
| 2008/0156048 | A1 * | 7/2008 | Topfer | 70/77 |
| 2008/0202175 | A1 * | 8/2008 | Riznik et al. | 70/77 |

FOREIGN PATENT DOCUMENTS

| | | | |
|---|---|---|---|
| EP | 509217 | A1 * | 10/1992 |
| EP | 0 637 666 | A1 | 2/1995 |
| EP | 0 940 532 | A2 | 9/1999 |
| EP | 1234938 | A2 * | 8/2002 |
| EP | 1 857 617 | A2 | 11/2007 |
| EP | 1857617 | A2 * | 11/2007 |
| EP | 2186974 | A1 * | 5/2010 |
| FR | 2620482 | A1 * | 3/1989 |

* cited by examiner 1
4
5
37
8
3
36
12
10
6
35
24
9
20

36
35
24

1
4
6
5
37
35
24
33
8
3
36
20
32
2
19
15
12
9
10

CYLINDER LOCK WITH PIVOTALLY-MOUNTED BOLT

BACKGROUND OF THE INVENTION

The present invention relates to a cylinder lock with a pivotally-mounted bolt.

As "cylinder lock" it is meant any lock which can receive a lock cylinder for actuation of said bolt. As "lock cylinder", it is meant a lock mechanism with a housing having a standard profile, such as the europrofile, the British oval profile, or the Swiss profile, and a cylinder with a radially protruding cylinder cam and a key groove, wherein the cylinder can only be rotated within the standard profile with a key inserted into said key groove if said key has a suitable profile for unlocking said lock mechanism, which can be of any suitable type, such as the pin tumbler type, the wafer tumbler type, or the disc tumbler type.

As "pivotally-mounted bolt" it is meant a bolt pivotally moveable between a retracted position and an extended position. Such a pivotally-mounted bolt has advantages over a translating bolt, such as a potentially bigger cross-section, and thus greater resistance to breakage and a longer reach by reduced space. Moreover, such a pivotally-mounted bolt can take the form of a hooked bolt, which, in said locking position, prevents that the lock and the striker plate receiving the bolt opposite to the lock be forced apart.

European patent EP 940 532 B1 illustrates such a cylinder lock, comprising:

a housing with an opening for receiving a lock cylinder with a radially protruding cam;

a bolt pivotally moveable between an retracted position and an extended position with respect to said housing;

a ring comprising a radial opening for engaging said lock cylinder cam, so as to couple said ring and lock cylinder cam, and a toothed arc with a first end adjacent to said radial opening, and a second end;

a slider, coupled between said pivotally-mounted bolt and said ring and comprising a toothed rack for engaging said toothed arc and a recess adjacent to a first end of said toothed rack for engaging said lock cylinder cam, wherein said housing presents a guide for guiding said slider between a first position holding the bolt in said retracted position and a second position holding the bolt in said extended position.

A drawback of this prior art is that the slider is not reliably retained when the bolt is in its extended position. As a result, the slider forms a vulnerable point in the lock which could potentially be exploited with malicious intent. In this prior art cylinder lock, a number of security measures are proposed to neutralise this vulnerability, notably a movable fulcrum for the pivotally-mounted bolt. However, these security measures are complex and costly, and add additional potential sources of failure.

Another drawback of the abovementioned prior art is that the slider is not reliably retained when the bolt is in its retracted position. As a result, the slider may move out of correct engagement with the ring, in particular when the lock is shipped without a lock cylinder. This can then complicate the correct assembly and installation of the lock. It is a first object of the invention to maintain the correct position of the slider when the bolt is extended and/or when the bolt is retracted, so as to ensure the reliability, and security of the cylinder lock.

SUMMARY OF THE INVENTION

The present invention achieves this object in that said ring comprises a raised flank extending over a second arc of said ring from said second end of the toothed arc, and said slider comprises at least one stop opposable to said raised flank of the ring in at least one of said first or second positions of the slider so that the raised flank prevents the return of the slider towards the other one of said first or second positions. Preferably, at least one stop in the slider comprises a stop opposable to said raised flank of the ring in said second position of the slider so that the raised flank prevents the return of the slider towards the first position. Thus, if the lock cylinder is turned until the toothed arc displaces the slider to said second position, the raised flank of the ring comes into a position where it is opposed to the stop of the slider, thus preventing a return of the slider towards the first position. The ring can be turned further over the whole second arc and still retain the slider in said second position.

It is a further object of the present invention to ensure the reliability, and ease of installation of the cylinder lock.

For this purpose, said at least one stop in the slider may comprise a flank of said recess opposable to said raised flank of the ring in said first position of the slider so that the raised flank prevents the return of the slider towards the second position.

Preferably, said at least one guide comprises at least one end stop. The guide thus prevents movement of the slider beyond said first and/or second positions. Preferably the guide comprises two end stops, one for preventing movement of the slider beyond its first position and a second one for preventing movement of the slider beyond its second position. Alternatively, or additionally, one or the two end stops may be provided in a further guide for the slider.

It is a further object of the present invention to provide a simplified kinematic connection between the slider and the bolt. For this purpose, said slider may present a cam for engaging a recess on said bolt so as to pivot said bolt between said retracted and extended positions. More advantageously, the bolt, in its extended position, may contact said slider cam at a substantial angle to said slider guide. With this self-locking configuration, it will not be possible to move the slider along the guide by forcing the bolt towards its retracted position. Also more advantageously, the bolt, in its extended position, may contact said slider cam at a substantial angle to said slider guide. With this self-locking configuration, it will not be possible to move the slider along the guide by forcing the bolt towards its extended position.

A further drawback of the abovementioned prior art cylinder lock is that, when installed in a gate, the lock may be forced apart from an opposite strike plate by deforming the gate, thus driving the bolt out of the strike plate and unlocking the gate.

It is a further object of the present invention to provide a lock whose extended bolt will resist attempts to force the lock apart from a strike plate engaged by the extended bolt. For this purpose, the bolt may be hook-shaped.

It is a further object of the present invention to provide haptic feedback to the user of the lock when the slider reaches said first and/or second position. For this purpose, the cylinder lock may also comprise a detent mechanism for marking said first and/or or second position of the slider. Preferably, said detent mechanism may comprise a spring-loaded detent member fixed to one of said slider or housing, and at least one recess in the other of said slider or housing for receiving said spring-loaded detent member when the slider is in said first and/or second position.

Preferably, the cylinder lock may also comprise a latch spring-loaded towards an extended position. Furthermore, said latch may also be coupled to said lock cylinder cam, so as to be retractable against said spring load by rotation of said lock cylinder cam. Also, said latch may also be coupled to a handle, so as to be retractable against said spring load by rotation of said handle.

The present invention also relates to a cylinder lock according to the invention further comprising a lock cylinder in said opening, and to a gate comprising a fixed frame with a strike plate and a movable closure element with a cylinder lock according to the invention, wherein the bolt of the cylinder lock is aligned with said strike plate.

BRIEF DESCRIPTION OF THE DRAWINGS

Particular embodiments of the invention will now be described in an illustrative, but not restrictive form, with reference to the following figures.

DETAILED DESCRIPTION OF THE INVENTION

Figure 1:
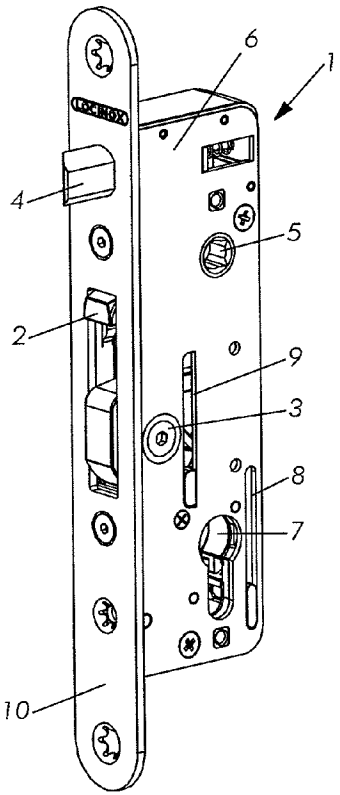
FIG. 1 shows a perspective view of an embodiment of a cylinder lock according to the invention.

Turning to FIG. 1, the illustrated cylinder lock 1 according to a preferred embodiment of the invention is shown in the form in which it is usually shipped, that is, without lock cylinder or handle and with the bolt 2 in a retracted position. The cylinder lock 1 comprises a bolt 2 mounted pivotally on a fulcrum 3, a latch 4 spring-biased towards the illustrated extended position, a shaft 5 for driving said latch 4 against its extension bias, and a housing 6 presenting an opening 7 for receiving a europrofile lock cylinder, guides 8, 9 and a front plate 10.

Figure 2:
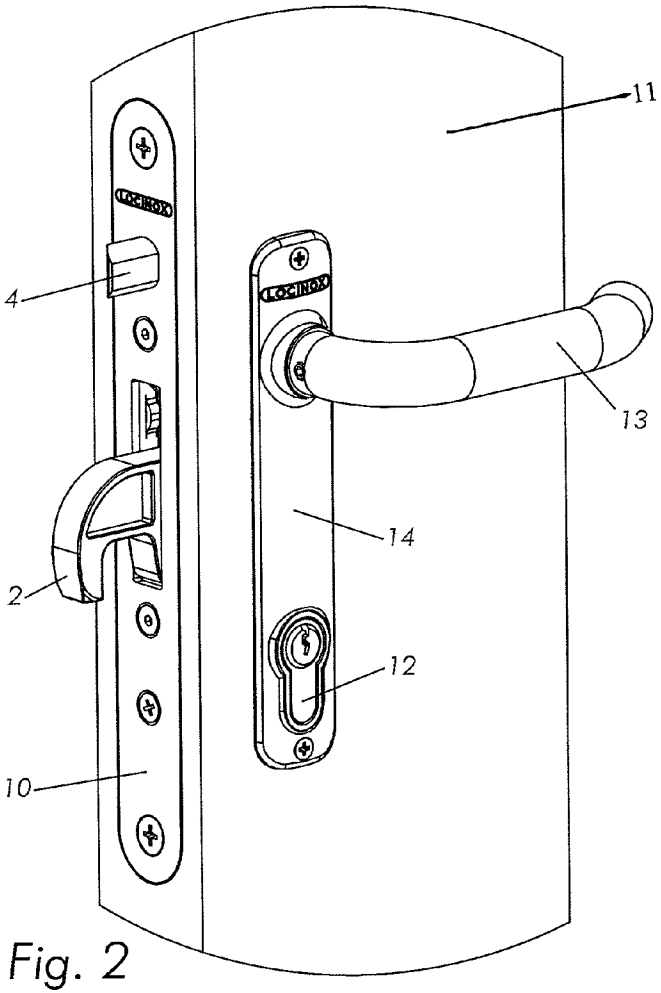
FIG. 2 shows another perspective view of the cylinder lock of FIG. 1, installed within a door, and receiving a conventional europrofile lock cylinder.

FIG. 2 shows the same cylinder lock 1 installed in a gate 11, with a lock cylinder 12 mounted in said opening 7, a handle 13 fixed to said shaft 5, and a cover plate 14. The bolt 2 is shown here in its extended position, in which its hook shape, pointing towards its deployment direction, becomes apparent.

Figure 3B:
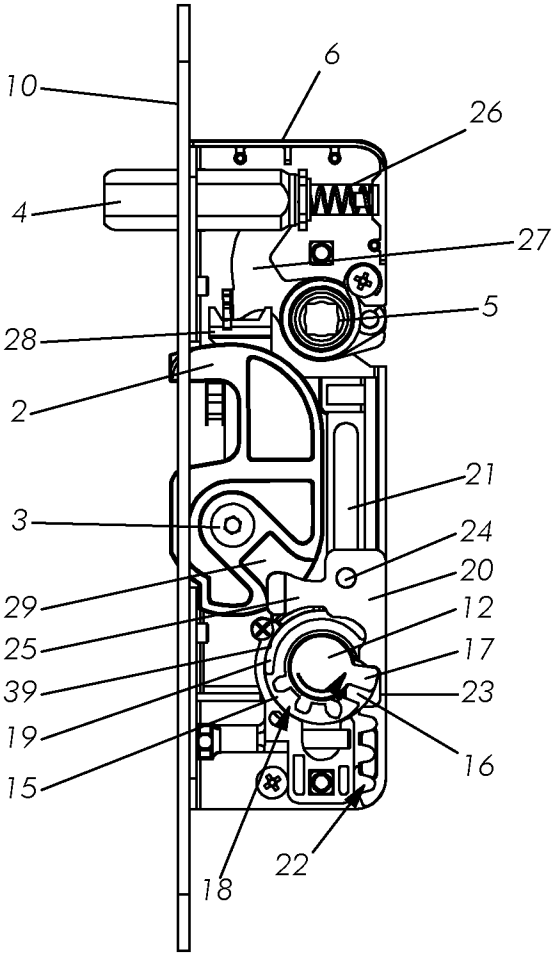
FIGS. 3*a*-3*h* are a sequence of a cutaway side views of the cylinder lock of FIG. 1 with a lock cylinder installed, with the bolt going from its retracted to its extended position.
Figure 3A:
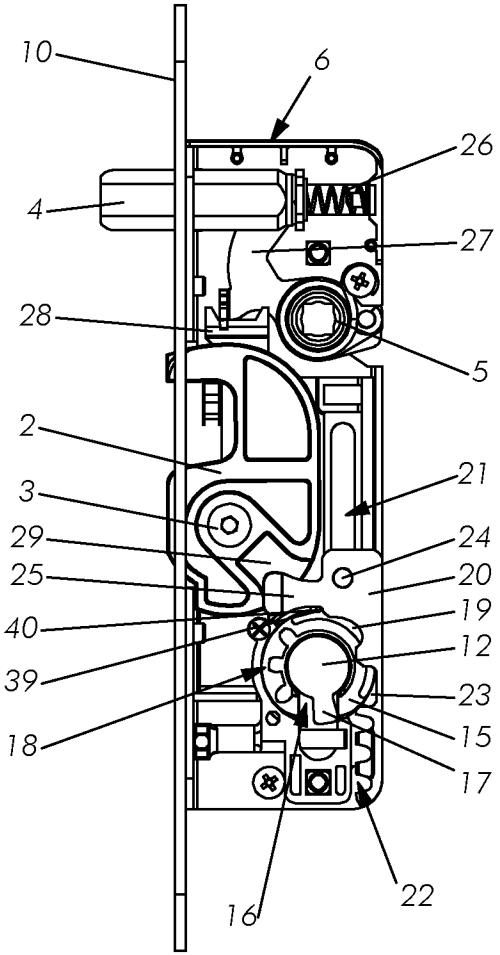

The inside of the housing 6 is visible in FIG. 3*a*. A ring 15 is mounted around the lock cylinder 12. Said ring 15 presents a radial opening 16 for allowing the passage of the lock cylinder 12, and also for engaging the lock cylinder cam 17. Opposite to said radial opening 16, the ring 15 of the illustrated embodiment presents a centering notch 39 which cooperates with a resilient member 40 in the lock 1 to locate the ring 15 in a default position in which the radial opening 16 of the ring is aligned with the opening 7 in the housing 6, so that the lock cylinder 12 can be installed and/or extracted.

The ring 15 also comprises a toothed arc 18 and a raised flank 19 over a second arc. The lock 1 also comprises a slider 20, in engagement with the abovementioned guiding grooves 8, 9 and an opposite, parallel guide 21. The guides 8, 9 and 21 are preferably linear. This slider 20 comprises a toothed rack 22, a recess 23, a blind hole 24, and a cam 25 protruding substantially perpendicularly to said guides 8, 9 and 21. Said cam 25 contacts the bolt 2 behind said fulcrum 3, seen from the front plate 10 of the lock.

Furthermore, the lock 1 also comprises a compression coil spring 26 biasing said latch 4 towards its extended position and an arm 27 coupled to said shaft 5 and an auxiliary slider 28 for retracting said latch 4.

In FIG. 3*a*, the bolt 2 is illustrated in its retracted position. In this position of the bolt 2, the slider 20 is in a first, lower position in which its cam 25 contacts the bolt 2 substantially perpendicularly to said guides 8, 9, 21.

Figure 3E:
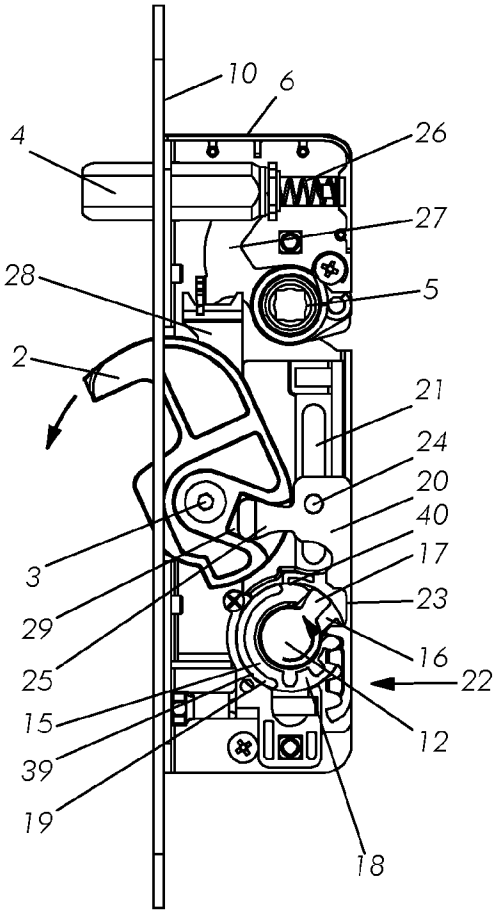
Figure 3D:
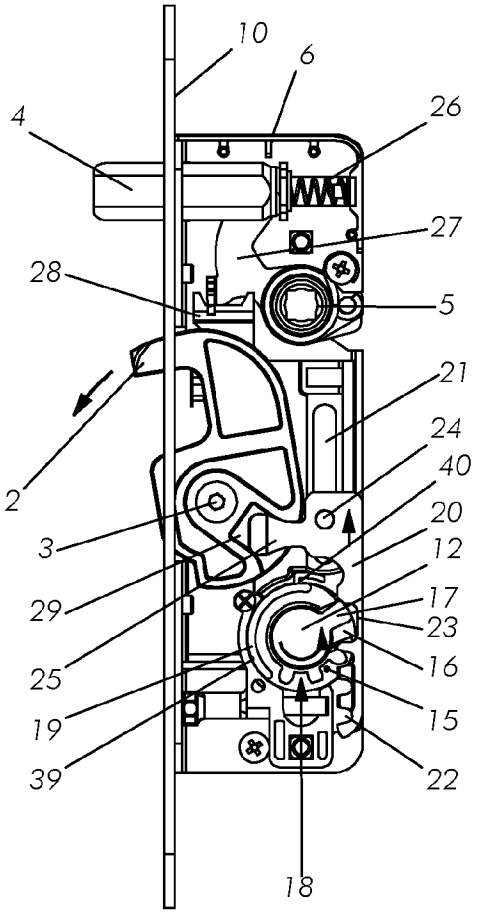
Figure 3C:
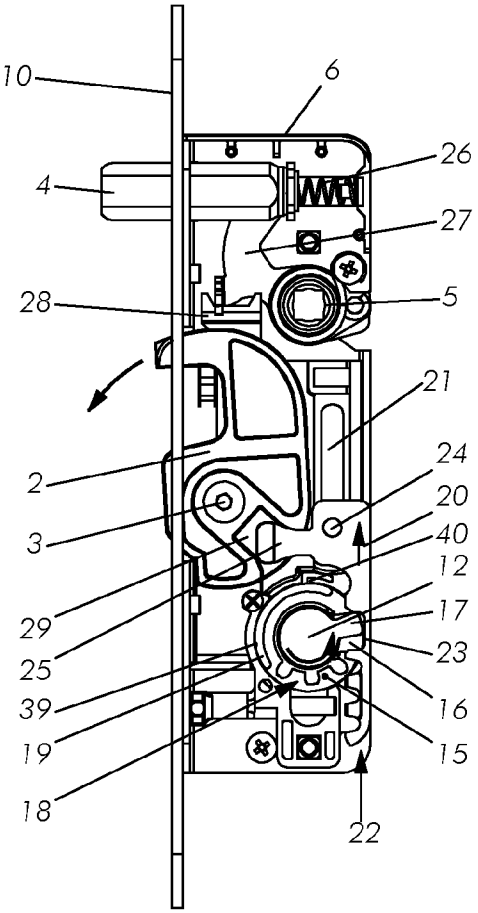
Figure 3H:
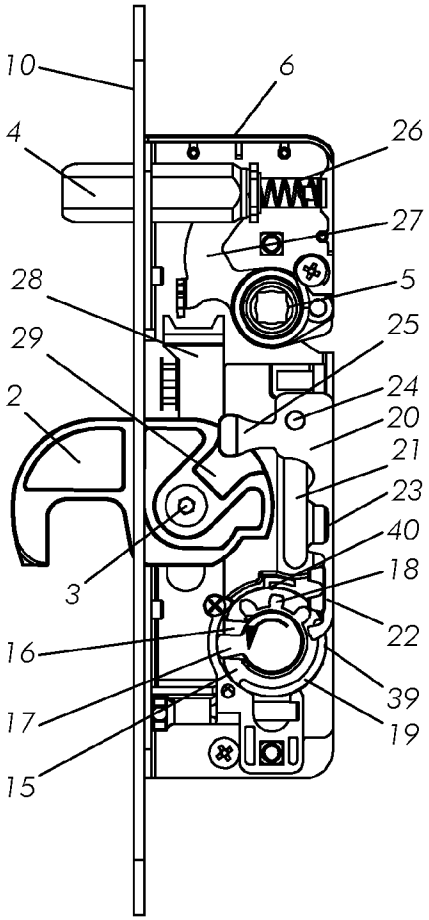
Figure 3G:
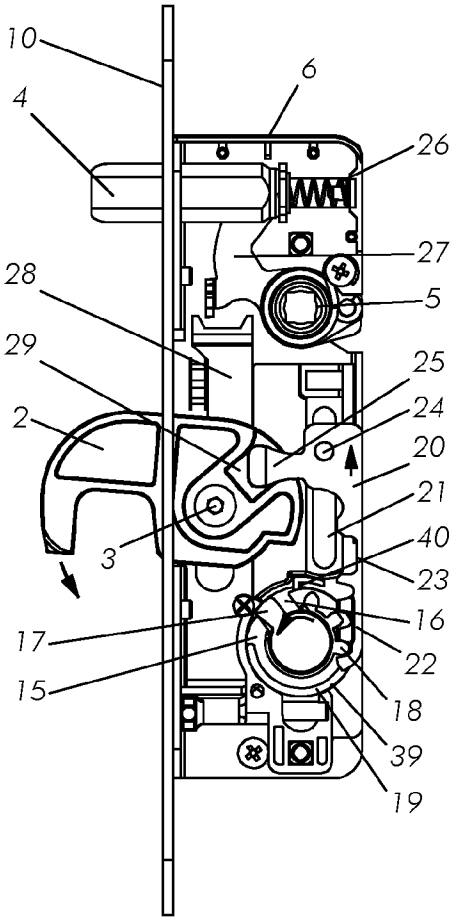
Figure 3F:
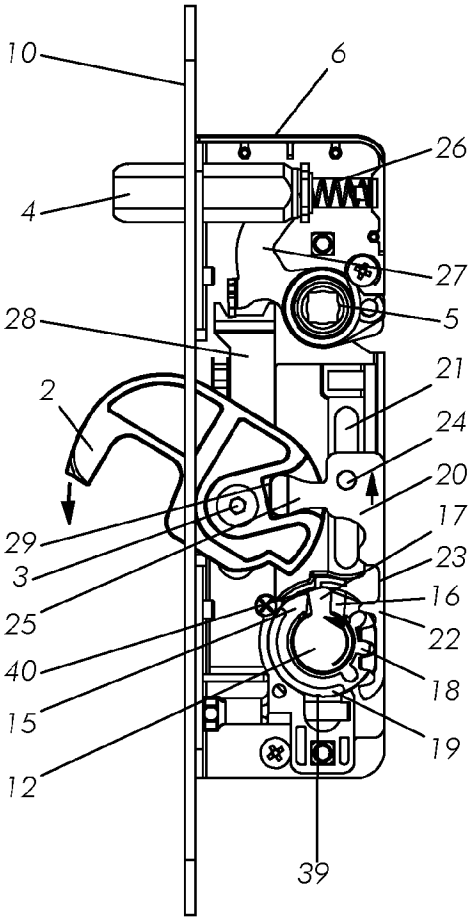

FIGS. 3*b*-3*h* illustrate the process of deploying the bolt 2 from its retracted position illustrated in FIG. 3*a*. As shown in FIG. 3*b*, as the cylinder cam 17 is rotated counter-clockwise from the position of FIG. 3*a*, it comes to engage the recess 23 in the slider 20, pushing said slider 20 upwards. As shown in FIG. 3*c*, the slider cam 25 engages a recess 29 in the bolt 2. In FIG. 3*d* it is shown how, after the cylinder cam 17, the toothed arc 18 comes to engage the slider 20, and namely its toothed rack 22, to continue displacing the slider 20 upwards once the cylinder cam 17 rotates out of engagement with the recess 23 in the slider 20, as illustrated in FIG. 3*e*. In FIGS. 3*f* and 3*g* it is shown how, as the cylinder cam 17 and the ring 15 continue their counter-clockwise rotation, subsequent teeth of the toothed arc 18 engage the toothed rack 22 to continue the upwards motion of the slider 20. Over this whole motion, the slider cam 25 remains in engagement with the bolt recess 29, tilting the bolt 2 towards its extended position, shown in FIG. 3*h*. In this extended position of the bolt 2, the slider 20 is in a second, higher position in which the slider cam 25 no longer engages the bolt recess 29, but instead contacts the bolt 2 substantially perpendicularly to the guides 8, 9, 21.

As in both the retracted and the extended positions of the bolt 2 the contact between the slider cam 25 and the bolt 2 is substantially perpendicular to the slider guides 8, 9, 21, and thus self-locking, trying to force the bolt 2 from outside the lock 1 will normally not displace the slider 20 in the direction of its guides 8, 9, 21. However, the raised flank 19 of the ring 15 further ensures the correct positioning of the slider 20 in the corresponding first and second positions, as illustrated in FIGS. 4*a*-4*c* and 5*a*-5*c*.

Figure 4B:
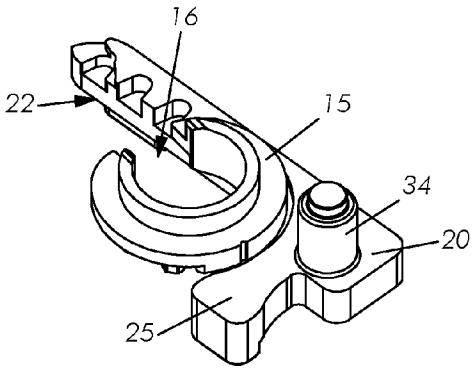
FIGS. 4*a*-4*c* are detail perspective views of the set of ring and slider of the same cylinder lock in the retracted bolt position illustrated in FIG. 3*a;*
Figure 4A:
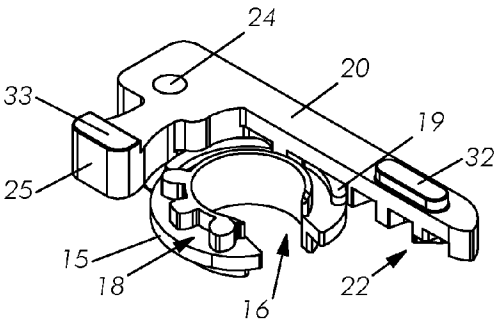
Figure 4C:
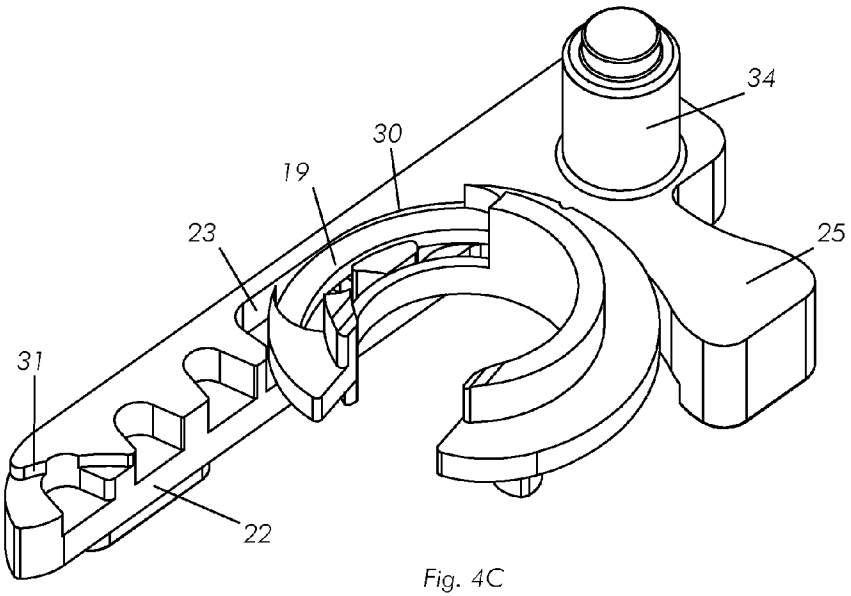

In FIGS. 4*a*-4*c*, the ring 15 and slider 20 are depicted in the first, lower position of the slider 20, corresponding to the retracted position of the bolt 2, as seen from three different viewpoints. As can be seen in FIG. 4*a*, the slider 20 comprises protrusions 32 and 33 on one side, for engaging, respectively, guides 8 and 9, and pin 34 on the other side for engaging guide 21. The slider is thus only movable in the axis of those guides 8, 9 and 21. In this first position, the raised flank 19 of the ring 15 opposes the upper flank of the recess 23, locking the slider 20 into this first, lower position even as the ring 15 is rotated over said second arc. As can be seen in particular in FIG. 4*c*, the raised flank 19 threads within the groove 30 carved into the slider, so that the ring 15 can be rotated over said second arc. A lower end stop at any of the guides 8, 9 or 21 prevents movement of the slider 20 in a downwards direction.

Figure 5A:
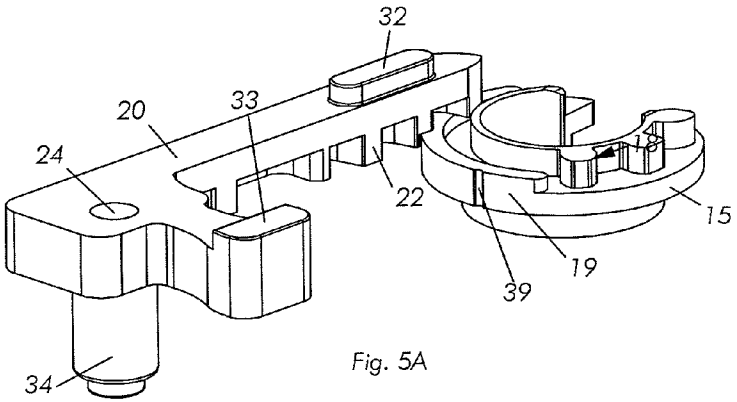
FIGS. 5*a*-5*c* are detail perspective views of the set of ring and slider of the same cylinder lock in the extended bolt position illustrated in FIG. 3*h;*
Figure 5B:
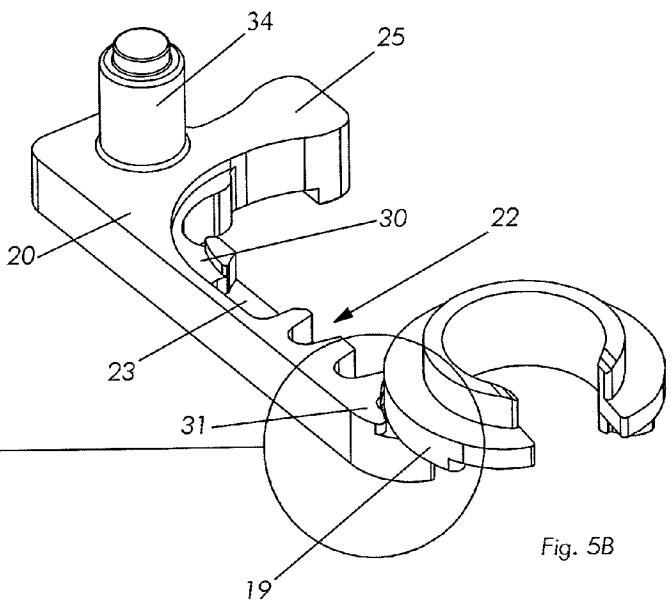
Figure 5C:
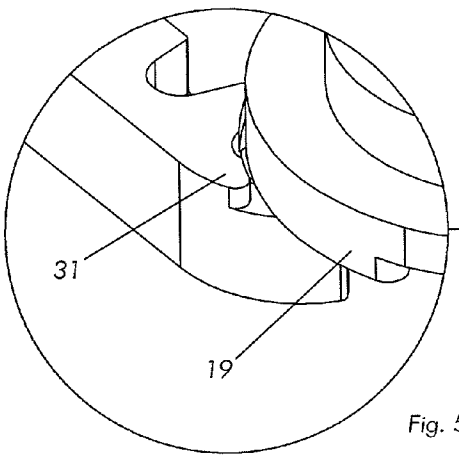

In FIGS. 5*a*-5*c*, the ring 15 and slider 20 are depicted in the second, upper position of the slider 20, corresponding to the extended position of the bolt 2, as seen from three different viewpoints. As can be seen in particular in FIGS. 5*b* and 5*c*, in this position, the raised flank 19 of the ring 15 opposes a raised stop 31 in the slider 20, preventing the return of the slider 20 in a downwards direction. Further motion of the slider 20 in an upwards direction may be prevented by an end stop in at least one of the guides 8, 9, 21. The slider 20 is thus locked into this second, upper position even as the ring 15 is rotated over said second arc.

Figures 6A, 6B, 6C:
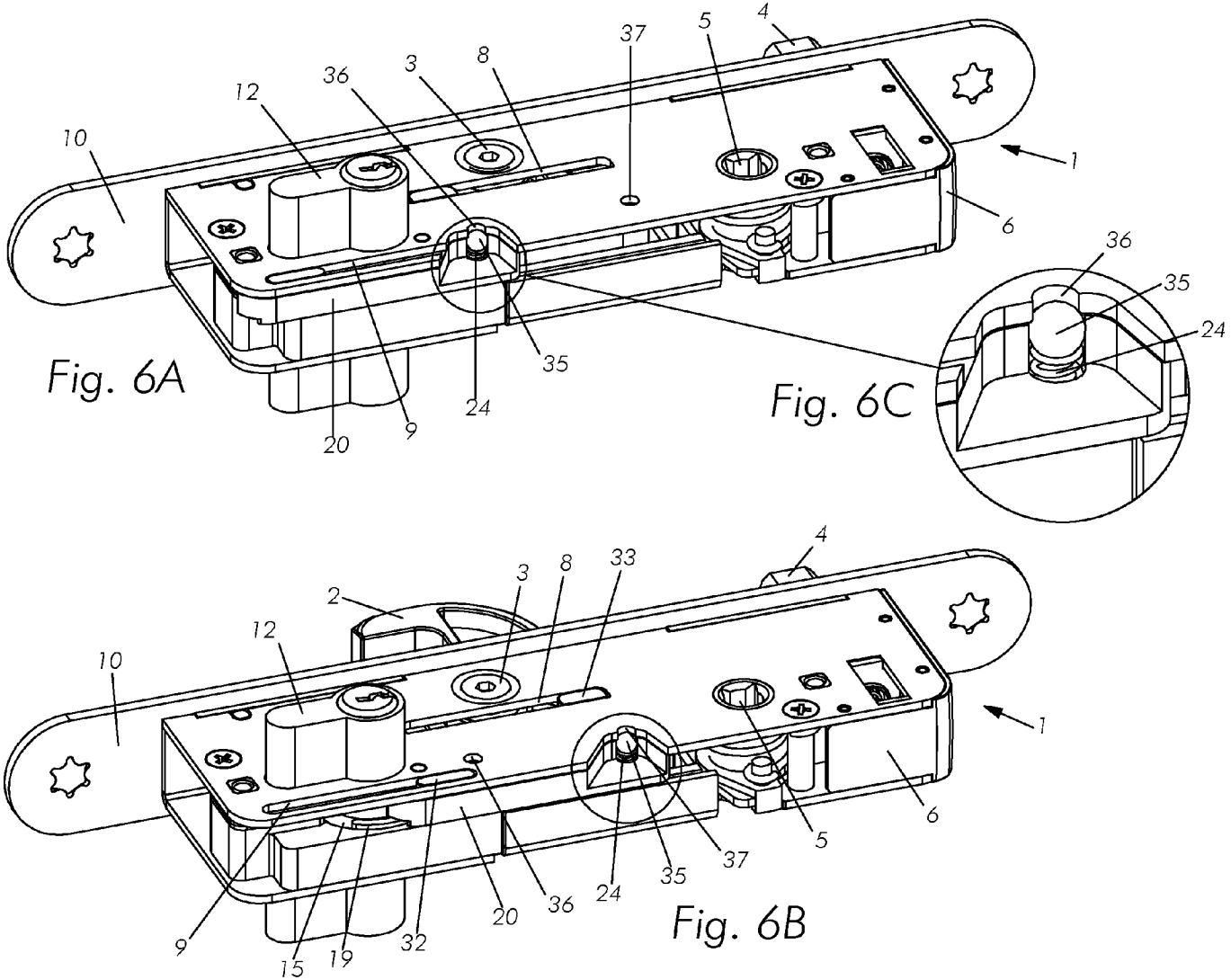
FIG. 6*a* and FIG. 6*b* are perspective views of the same cylinder lock in, respectively, the retracted position illustrated in FIG. 3*a* and the extended position illustrated in FIG. 3*h;*
FIG. 6*c* is a detail view of a detent mechanism of the same cylinder lock.

As illustrated in FIGS. 6*a*-6*c*, in order to further ensure the correct positioning of the slider 20 and also offer a haptic feedback to the user as he turns the key within the lock cylinder 12 to rotate the lock cylinder cam 17, translate the slider 20 and tilt the bolt 2 between its retracted and extended positions, the lock 1 also comprises a detent mechanism formed by a spring-loaded member 35 within the blind hole 24 of the slider 20, and two recesses 36, 37 in the housing 6, located so that said spring-loaded member 35 clicks into a first recess 36 when the slider 20 is at his first, lower position, as seen in FIGS. 6*a* and 6*c*, and into a second recess 37 when the slider 20 is at his second, upper position, as seen in FIG. 6*b*.

Figure 7:
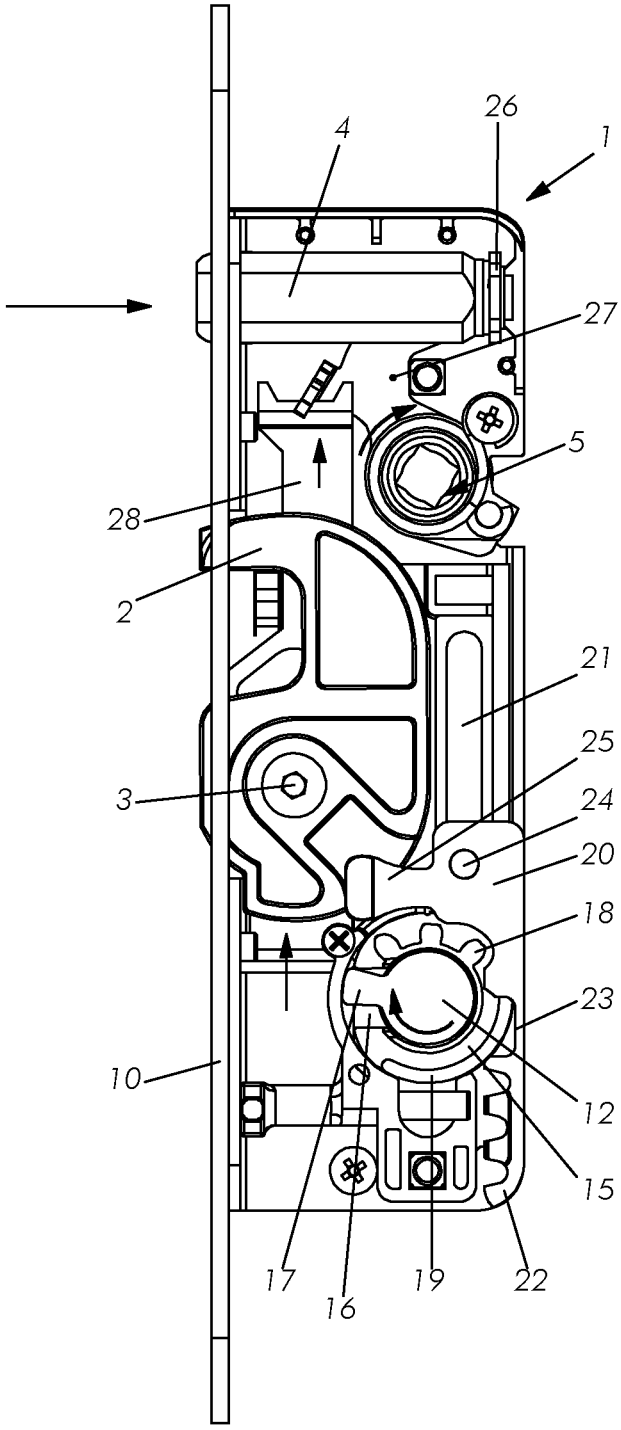
FIG. 7 is a cutaway side view of the cylinder lock of FIG. 1, with both bolt and latch retracted.

The sequence illustrated in FIGS. 3*a*-3*h* can be reversed to tilt the bolt 2 from its extended position towards its retracted position by turning the cylinder cam 17 clockwise from the position illustrated in FIG. 3*h*. Turning it clockwise even further from the position of FIG. 3*a*, as shown in FIG. 7, the cylinder cam 17 engages the auxiliary slider 28, driving it upwards. The auxiliary slider 28 in turn drives the arm 27, retracting the latch 4 against the spring 26.

Although the present invention has been described with reference to specific exemplary embodiments, it will be evident that various modifications and changes may be made to these embodiments without departing from the broader scope of the invention as set forth in the claims. Accordingly, the description and drawings are to be regarded in an illustrative sense rather than a restrictive sense.

The invention claimed is:

1. A cylinder lock comprising:

a housing with an opening for receiving a lock cylinder with a radially protruding cam;

a bolt pivotally moveable by means of said lock cylinder between a retracted position with respect to said housing, wherein the cylinder lock is in an unlocked state, and an extended position with respect to said housing, wherein the cylinder lock is in a locked state;

a ring comprising a radial opening for engaging said radially protruding cam, so as to couple said ring and said radially protruding cam, and a toothed arc with a first end and a second end, wherein said first end is adjacent to said radial opening;

a slider, coupled between said bolt and said ring and comprising a toothed rack for engagement with said toothed arc, and a recess adjacent to said toothed rack for engagement with said radially protruding cam, wherein said housing comprises at least one guide for guiding said slider between a first position holding the bolt in said retracted position and a second position holding the bolt in said extended position, said ring and said slider being arranged so that, when moving the slider from said first to said second position by rotating said ring by means of the radially protruding cam of the lock cylinder, the radially protruding cam comes to engage the recess in the slider to push said slider towards its second position after which the toothed arc comes to engage the toothed rack of the slider to continue displacing the slider towards its second position so that the radially protruding cam rotates out of engagement with the recess in the slider and vice versa when moving the slider from said second to said first position by rotating said ring by means of the radially protruding cam of the lock cylinder, the toothed arc comes to engage the toothed rack of the slider to push said slider towards its first position after which the radially protruding cam comes to engage the recess in the slider to continue displacing the slider towards its first position so that the toothed arc rotates out of engagement with the toothed rack of the slider;

wherein said ring comprises a raised flank extending over a second arc of said ring next to said second end of the toothed arc;

wherein said slider comprises a stop opposable to said raised flank of the ring in said second position of the slider so that the raised flank prevents the return of the slider towards said first position; and wherein said recess in the slider has a flank which is opposable to said raised flank of the ring in said first position of the slider so that the raised flank prevents the return of the slider towards the second position.

2. The cylinder lock according to claim 1, wherein said at least one guide comprises at least one end stop.

3. The cylinder lock according to claim 1, wherein said slider further comprises, adjacent to said recess and oppositely located to said toothed rack, a groove for allowing the passage of said raised flank of the ring in said first position of the slider.

4. The cylinder lock according to claim 1, wherein said slider presents a slider cam for engaging a recess in said bolt so as to pivot said bolt between said retracted and extended positions.

5. The cylinder lock according to claim 1, wherein said bolt is hook-shaped.

6. The cylinder lock according to claim 1, further comprising a detent mechanism for marking said first and/or second position of the slider.

7. The cylinder lock according to claim 6, wherein said detent mechanism comprises a spring-loaded detent member fixed to said slider, and at least one recess in said housing for receiving said spring-loaded detent member when the slider is in said first and/or second position.

8. The cylinder lock according to claim 1, further comprising a latch spring-loaded towards an extended position.

9. The cylinder lock according to claim 8, wherein said latch is also connectable to said radially protruding cam, so as to be retractable against said spring load by rotation of said radially protruding cam.

10. The cylinder lock according to claim 8, wherein said latch is also connected to a handle shaft, so as to be retractable against said spring load by rotation of said handle shaft.

* * * * *